US007024910B2

(12) United States Patent
Pyper et al.

(10) Patent No.: US 7,024,910 B2
(45) **Date of Patent: *Apr. 11, 2006**

(54) STOCK LIFTER FOR METAL FORMING DIES AND METHOD FOR MAKING THE SAME

(75) Inventors: Joel T. Pyper, Grand Rapids, MI (US); John K. Pyper, Grand Rapids, MI (US); Scott M. Breen, Grand Rapids, MI (US); Charles T. Brown, Grand Rapids, MI (US); Jeffery S. Pyper, Grand Rapids, MI (US)

(73) Assignee: Pyper Tool & Engineering, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/018,305

(22) Filed: Dec. 21, 2004

(65) Prior Publication Data

US 2005/0097938 A1 May 12, 2005

Related U.S. Application Data

(63) Continuation of application No. 10/268,477, filed on Oct. 10, 2002, now Pat. No. 6,848,290.

(51) Int. Cl.
*B21D 43/05* (2006.01)

(52) U.S. Cl. ..... 72/405.06; 72/421; 29/428

(58) Field of Classification Search ..... 72/405.06, 72/328, 426, 421, 345, 361; 267/130; 83/373; 29/428

See application file for complete search history.

(56) References Cited

U.S. PATENT DOCUMENTS 2,314,138 A 3/1943 Garbe et al.
2,346,297 A 4/1944 Garbe
2,616,763 A 11/1952 Vose et al.

(Continued)

FOREIGN PATENT DOCUMENTS

JP 459139 2/1992

OTHER PUBLICATIONS

DADCO, Inc. "Two Post Direct Lift," Dated prior to Oct. 10, 2001, Best Copy Available (USA), p. 1.

(Continued)

*Primary Examiner*—Daniel C. Crane
(74) *Attorney, Agent, or Firm*—Price, Heneveld, Cooper, DeWitt & Litton, LLP

(57) ABSTRACT

A self-contained stock lifter is particularly adapted for use in multiple station, progressive metal forming dies and the like, and includes a base plate with two vertical through holes adjacent opposite sides, and a vertical spring unit aperture located between the through holes. The stock lifter also includes a lifter bar having two vertical through holes in vertical registry with the base plate through holes. Two rigid guide shafts are mounted in the base plate through holes to permit the lifter bar to reciprocate in a manner which selectively lifts stock in the die to permit longitudinal shifting of the stock along the multiple die stations. A spring unit has a base retained in the spring unit aperture, and a reciprocating rod biased outwardly, with a free end abutting a central portion of the lifter bar to shift the lifter bar to an extended position, thereby defining a fully self-contained unit that can be readily mounted in and removed from the die to reduce manufacturing and repair costs.

41 Claims, 8 Drawing Sheets

U.S. PATENT DOCUMENTS 3,292,412 A 12/1966 Costabile
3,722,257 A 3/1973 Bogart et al.
3,848,494 A 11/1974 Gargrave et al.
3,860,803 A 1/1975 Levine
3,908,500 A 9/1975 Gargrave et al.
3,945,230 A 3/1976 Tomioka et al.
4,235,089 A 11/1980 Vecchi
4,254,999 A 3/1981 Davidson
4,282,736 A 8/1981 Mashburn
4,326,402 A 4/1982 Wallis
4,676,090 A * 6/1987 Nishimura et al. ..... 72/404
4,809,533 A 3/1989 Owens
5,001,922 A 3/1991 Kranis, Sr. et al.
5,099,673 A 3/1992 Baur
5,168,745 A 12/1992 Miyagawa et al.
5,253,505 A 10/1993 Baur
5,301,119 A 4/1994 Watkins
5,335,529 A 8/1994 Crowdus et al.
5,540,073 A 7/1996 Kirii
5,706,696 A 1/1998 Wagner
5,931,074 A 8/1999 Matsuoka
5,954,175 A 9/1999 Haas et al.
5,974,852 A 11/1999 Nieschulz
5,983,688 A 11/1999 Anzai et al.
6,047,579 A 4/2000 Schmitz
6,134,938 A 10/2000 Ohtsuka
6,170,809 B1 1/2001 Cotter
6,651,304 B1 * 11/2003 McGlinchy et al. ..... 29/407.04

OTHER PUBLICATIONS

PHD Inc., "Series SCV Slides," Dated prior to Oct. 10, 2001, Best Copy Available (USA), pp. 2.

* cited by examiner 1
2
3
4
5
6
7
8
9
10
11
12
13
14
15
29
37
40
42
44
46
47
55
56
57
59
60
61
66
68
69
71
75
76
77
84
85
86
87
88
90
95
96
97
98
99

STOCK LIFTER FOR METAL FORMING DIES AND METHOD FOR MAKING THE SAME

This application is a continuation of U.S. Ser. No. 10/268,477, filed Oct. 10, 2002, now U.S. Pat. No. 6,848,290.

BACKGROUND OF THE INVENTION

The present invention relates to metal forming dies and the like, and in particular to a stock lifter and method for making the same.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various die components being handcrafted and custom mounted or fitted in an associated die set, as shown in FIG. 1, which is in turn positioned in a stamping press. Not only are the punches and other forming tools in the die set individually designed and constructed, but the other parts of the die set, such as stock lifters, stock guides, end caps and keepers, cam returns, etc., are also custom design, made and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture and repair or modify.

SUMMARY OF THE INVENTION

One aspect of the present invention is a progressive metal forming die having a self-contained stock lifter that includes a base plate with two vertical through holes adjacent opposite sides, and a vertical spring unit aperture located between the through holes. The stock lifter also includes a lifter bar having two vertical through holes in vertical registry with the base plate through holes. Two rigid guide shafts are mounted in the base plate through holes to permit the lifter bar to reciprocate in a manner which selectively lifts stock in the die to permit longitudinally shifting the stock along the multiple die stations. A spring unit has a base retained in the spring unit aperture, and a reciprocating rod biased outwardly, with a free end abutting a central portion of the lifter bar to shift the base plate and lifter bar to an extended position, thereby defining a fully self-contained unit that can be readily mounted in and removed from the die to reduce design, manufacturing and repair costs.

Another aspect of the present invention provides a method for making progressive metal forming dies and the like of the type having a lower die block, multiple metal forming stations, and a stock lifter which selectively lifts stock to permit shifting the stock longitudinally along the multiple stations. The stock lifter includes a base plate having opposite sides. First and second vertically oriented, mutually parallel mounting apertures are formed completely through the stock lifter base plate adjacent the opposite sides thereof.

At least one fastener mechanism is formed in the stock lifter for connecting the stock lifter to the lower die block of the metal forming die. At least one vertically oriented spring aperture is formed completely through the stock lifter base plate at a location generally intermediate the first and second mounting apertures. A lifter bar is provided, wherein third and fourth vertically oriented, mutually parallel mounting apertures are formed completely through the same, adjacent the opposite sides thereof, for vertical registry with the first and second guide shaft mounting apertures. At least two rigid guide shafts are provided, and are positioned between the base plate and the lifter bar so that ends thereof are received in the base plate mounting apertures to permit the lifter bar to reciprocate between extended and retracted positions to selectively lift the stock in the metal forming die and permit shifting the stock longitudinally along the multiple stations of the metal forming die. A self-contained spring unit is provided of the type having a base portion with a reciprocating rod portion extending outwardly thereof, and being biased outwardly to an extended position. The self-contained spring unit is positioned between the base plate and the lifter bar, such that the base portion of the spring unit is received and retained in the spring unit aperture of the base plate, and the free end of the rod portion abuts a central portion of the lifter bar to shift the lifter bar to the extended position. The stock lifter is placed on the lower die block of the metal forming die, and is detachably connected therewith, whereby the stock lifter can be readily mounted in and removed from the metal forming die to reduce the cost of designing, manufacturing and repairing the metal forming die.

The present invention provides self-contained and modular die components, such as stock lifters, etc., which allow flexible manufacturing and die specific dimensional requirements to be incorporated from design through build out of a specified metal forming die. Standard die components can be pre-made, yet have variable design attributes to match the specific requirements of the die. Preferably, the standard die components use conventional bushings, shafts, etc., and are readily replaceable. The present invention minimizes grinding, machining and heat treatment operations, and avoids the use of blind or flat bottom holes, recesses, cavities, etc. in the die set. The self-contained nature of the design greatly reduces the time, difficulty and expense associated with installing the assembly in a die set. The modular construction of the assembly substantially reduces the amount of time and effort necessary to design and make the assembly. The combined effects of the self-contained design and modular construction represent a significant advancement in the art of metal forming dies.

The present invention requires fewer components, less time to design, produce, install, repair and modify, and has a compact shape that can fit into small die areas, yet resists tipping or binding, and uses less material to make. Furthermore, the present invention is economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 11:
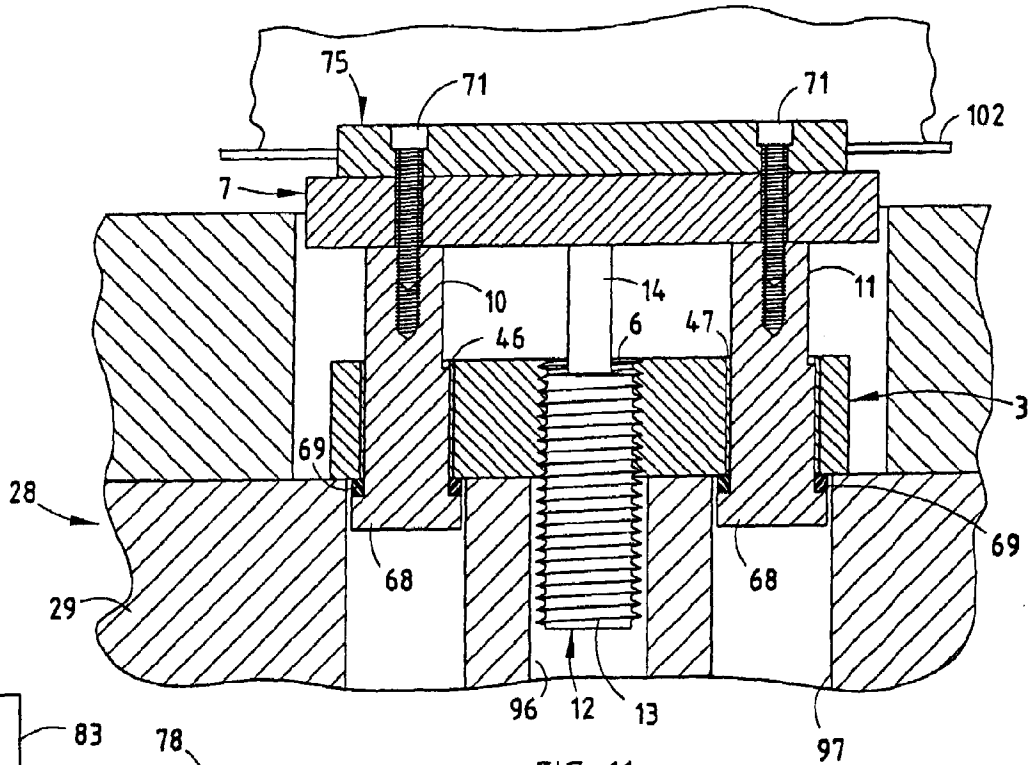
FIG. 11 is a vertical cross-sectional view of the stock lifter installed in an associated die set, shown in an extended position.
Figure 10A:
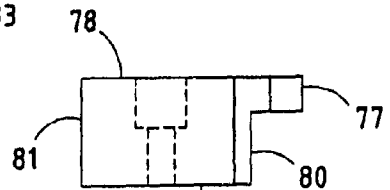
FIG. 10A is an end elevational view of the stock guide.
Figure 9:
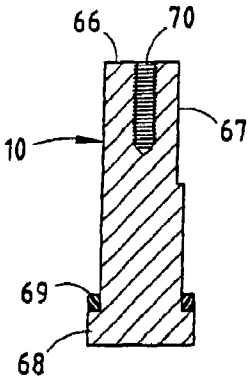
FIG. 9 is a vertical cross-sectional view of a guide shaft portion of the stock lifter.
Figure 10:
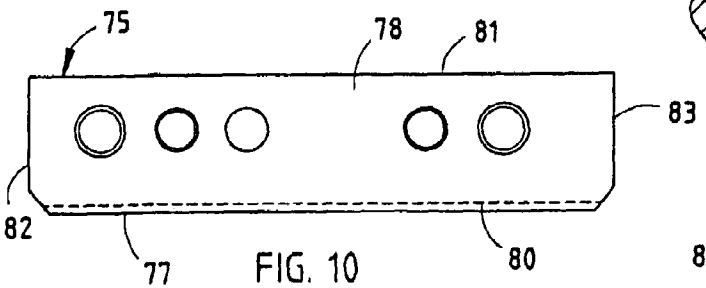
FIG. 10 is a top plan view of a stock guide portion of the stock lifter.
Figure 12:
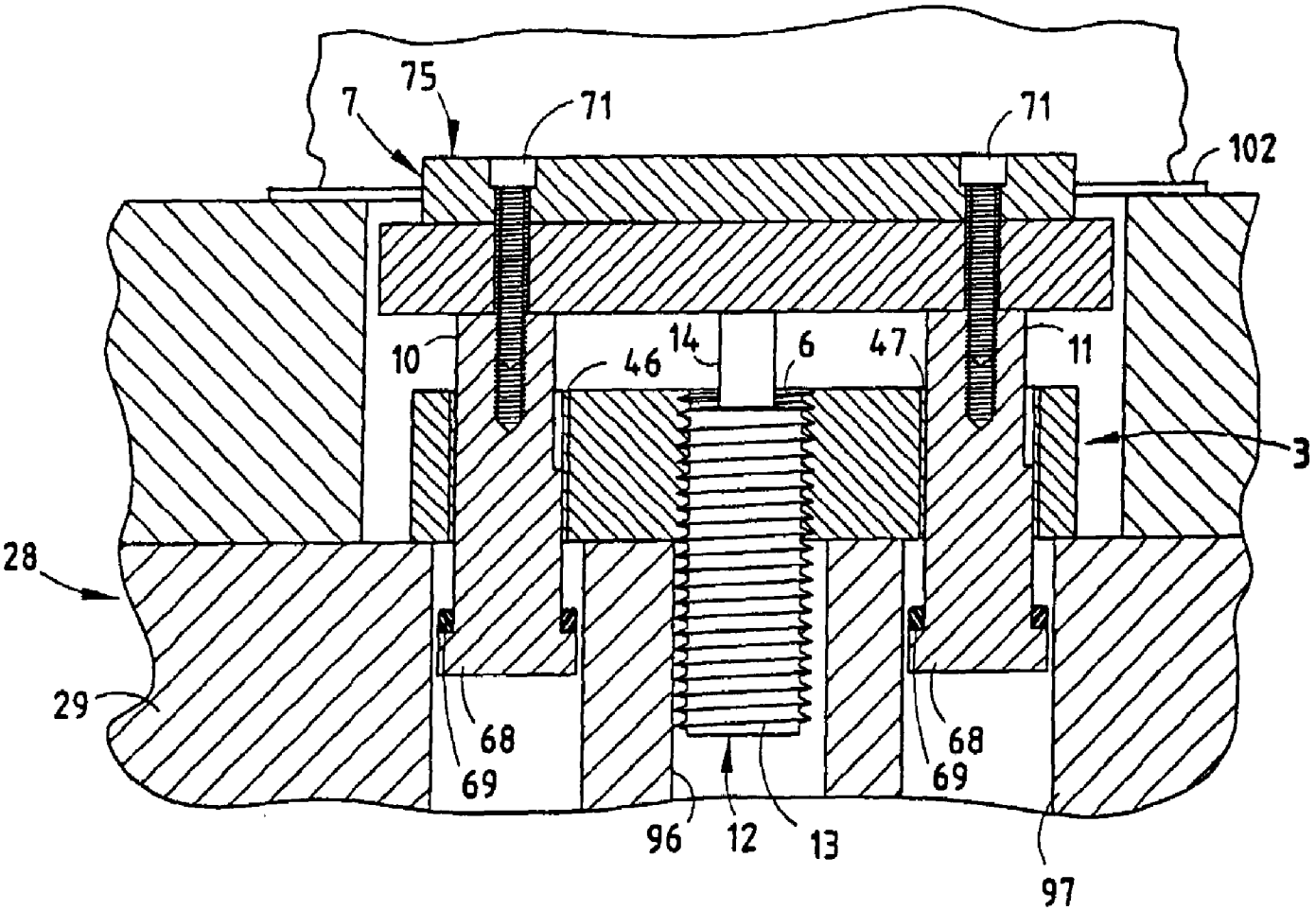
FIG. 12 is a vertical cross-sectional view of the stock lifter installed in an associated die set, shown in a retracted position.

For purposes of description herein, the terms "upper", "lower", "right", "left", "rear", "front", "vertical", "horizontal" and derivatives thereof shall relate to the invention as oriented in FIGS. 11 and 12. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims by their language expressly state otherwise.

Figure 2:
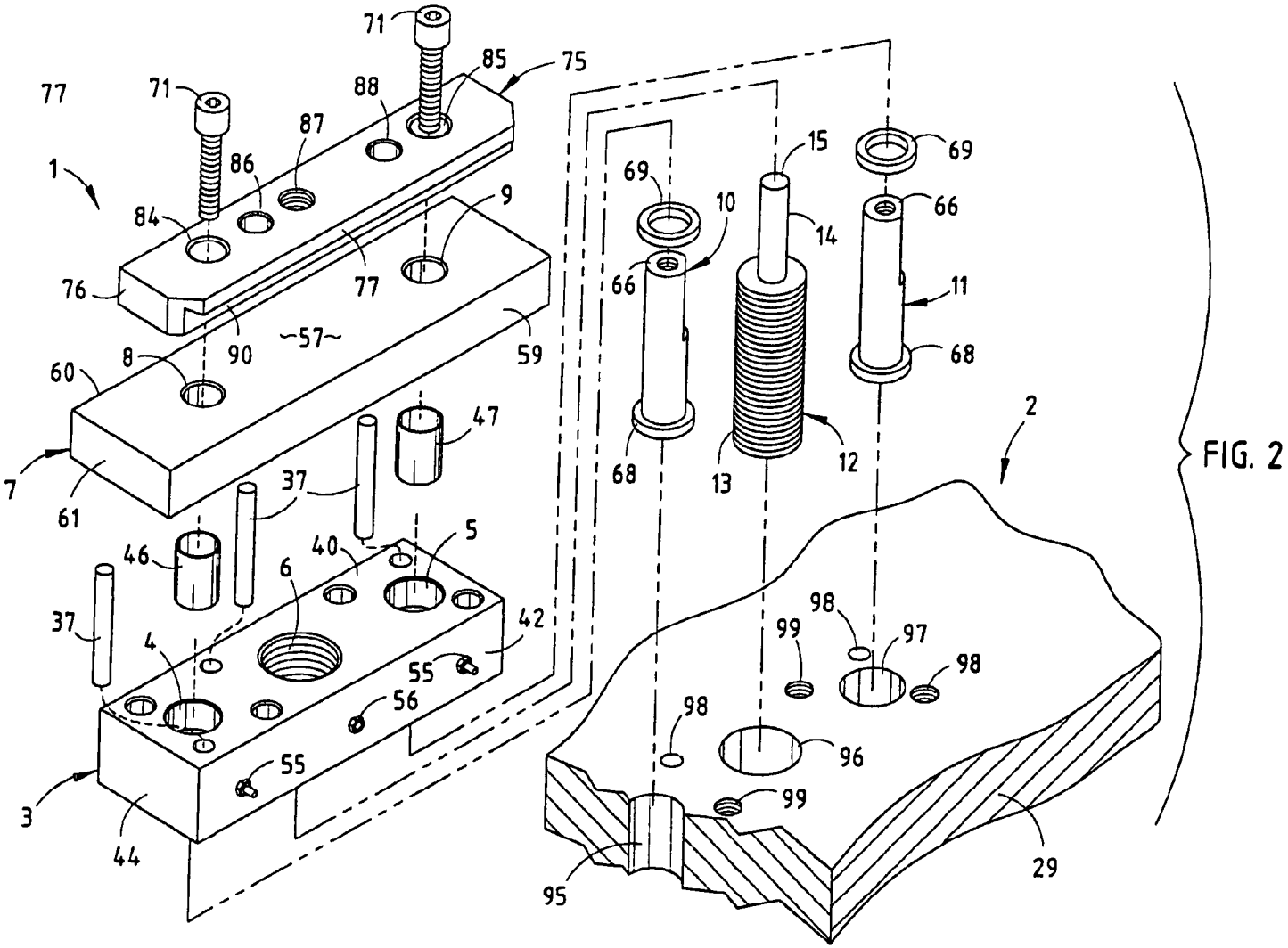
FIG. 2 is a partially schematic, exploded perspective view of a stock lifter embodying the present invention and a portion of an associated die block.
Figure 4:
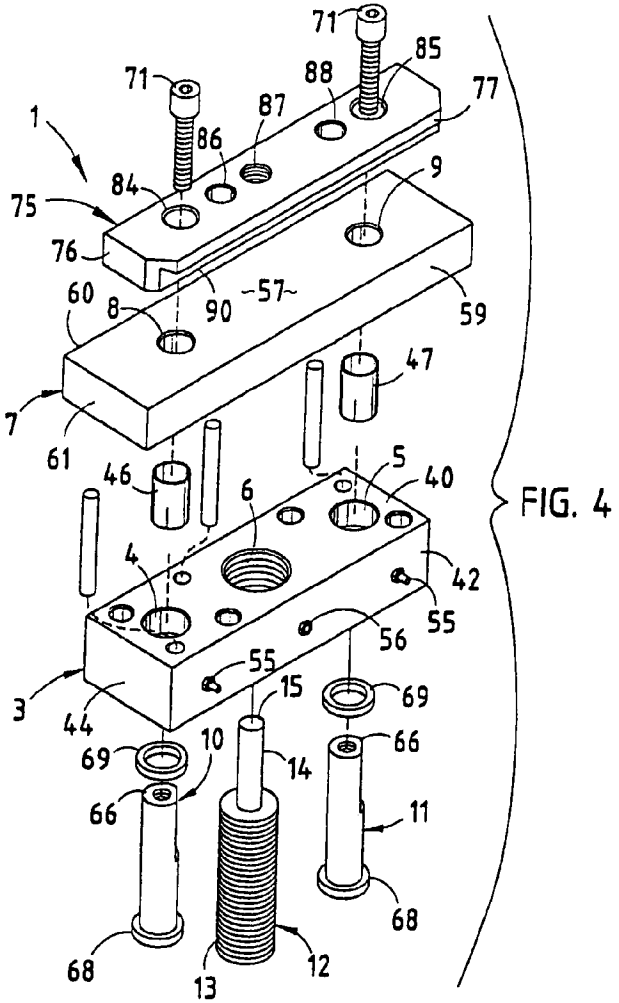
FIG. 4 is an exploded perspective view of the stock lifter shown in FIGS. 2 and 3.
Figure 3:
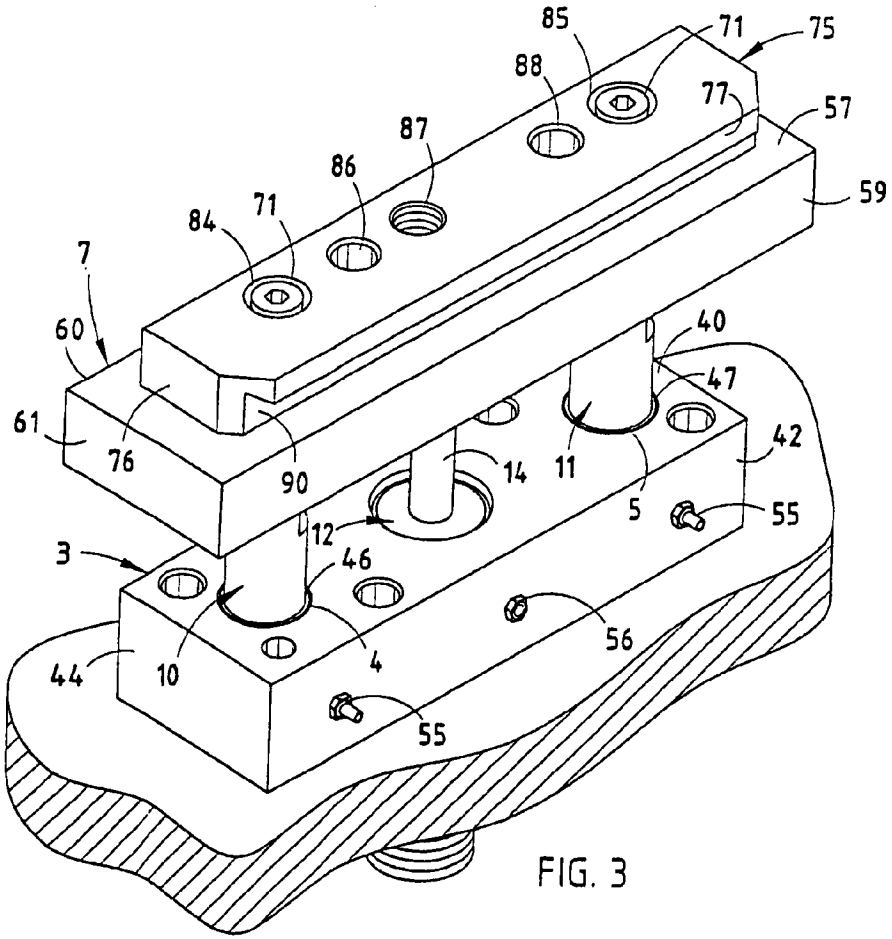
FIG. 3 is a perspective view of the stock lifter shown in FIG. 2.
Figure 7:
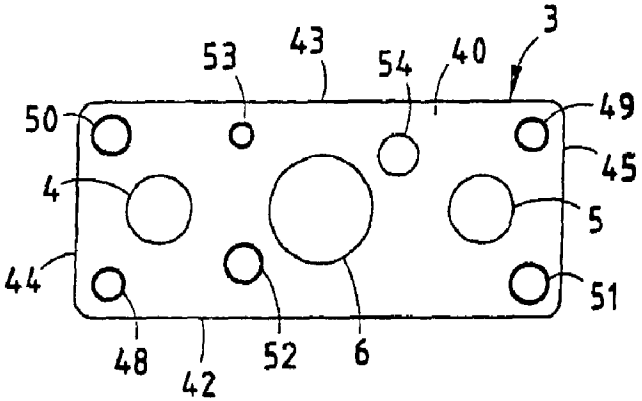
FIG. 7 is a top plan view of a base portion of the stock lifter.
Figure 8:
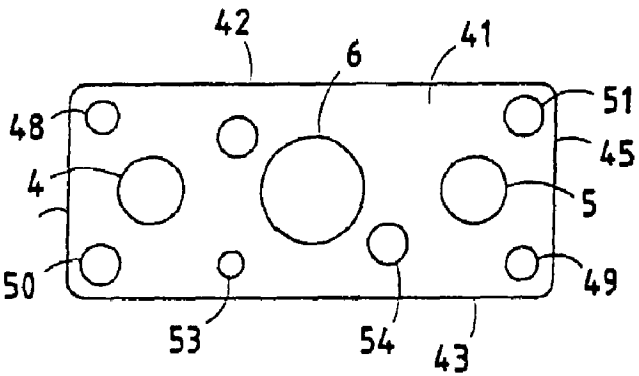
FIG. 8 is a bottom plan view of the base plate.
Figure 5:
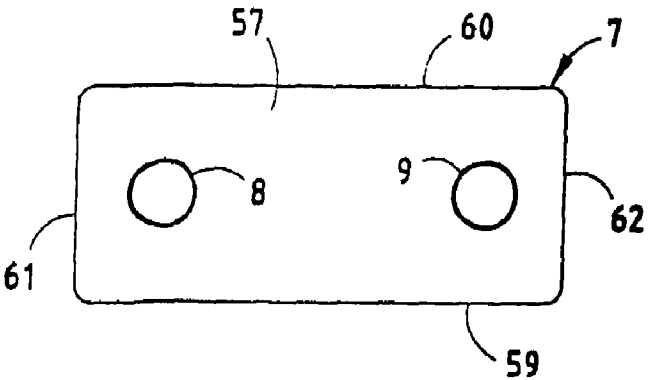
FIG. 5 is a top plan view of a lifter bar portion of the stock lifter.
Figure 6:
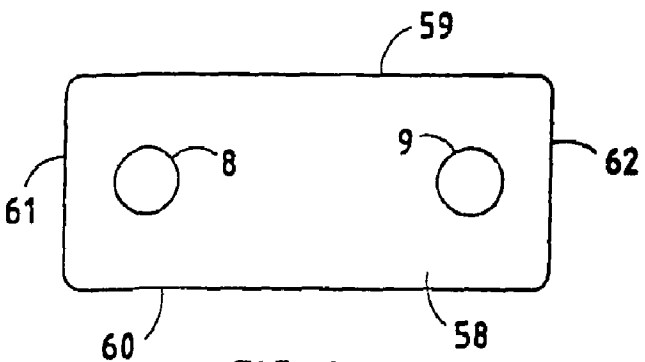
FIG. 6 is a bottom plan view of the lifter bar.

The reference numeral 1 (FIG. 2) generally designates a self-contained stock lifter embodying the present invention, which is particularly adapted for use in conjunction with multiple station, progressive metal forming dies and the like, such as the progressive metal forming die 2 illustrated in FIGS. 2, 11 and 12. Stock lifter 1 (FIG. 2) includes a base plate 3 with two vertical through holes 4 and 5 disposed adjacent opposite sides of base plate 3, and a vertical spring unit aperture 6 located between through holes 4 and 5. Stock lifter 1 also includes a lifter bar 7 having two vertical through holes 8 and 9 positioned in vertical registry with the through holes 4 and 5 of base plate 3. Two rigid guide shafts 10 and 11 are mounted in the through holes 4 and 5 of base plate 3 to permit lifter bar 7 to reciprocate in a manner which selectively lifts stock in the die 2 to permit longitudinal shifting of the stock along the multiple die stations in the manner shown in FIG. 11. A spring unit 12 has a base 13 retained in the spring unit aperture 6 of base plate 3, and includes a reciprocating rod 14 biased outwardly, with a free end 15 abutting a central portion of lifter bar 7 to shift lifter bar 7 to an extended position, as shown in FIG. 11. Stock lifter 1 has a fully self-contained type of construction that can be readily mounted in and removed from die 2 to reduce manufacturing and repair costs.

Figure 1:
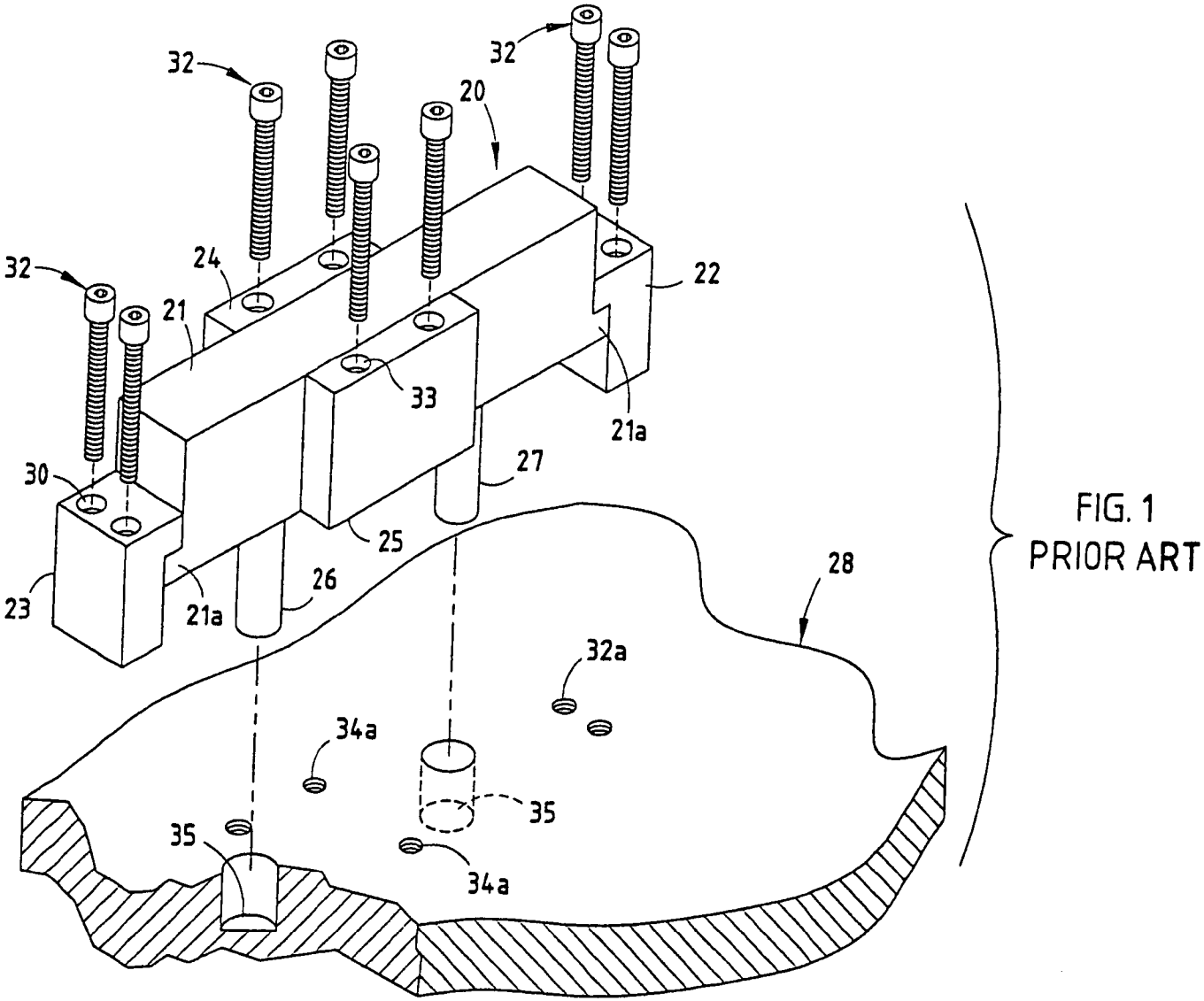
FIG. 1 PRIOR ART
FIG. 1 is a partially schematic, exploded perspective view of a prior art stock lifter and a portion of an associated die block.

FIG. 1 illustrates a prior art stock lifter 20 of the type that is individually designed for making a specific metal part, and includes various components 21–27, each of which is hand-crafted and custom mounted in an associated die set 28. In the example illustrated in FIG. 1, prior art stock lifter 20 includes a central block 21, which is individually designed and custom made from a block of steel, and has a substantially rectangular configuration with outwardly protruding ledges 21*a* at the bottom of opposite sides thereof. The prior art stock lifter 20 includes a pair of specially made, inverted L-shaped end blocks 22 and 23, which have precision formed, vertical through holes 30, and are mounted to the top surface of a bottom die plate or block 29 by fasteners 32, which are received in threaded holes 32*a*. End blocks 22 and 23 are precisely positioned to selectively engage the ledges 21*a* formed on central block 21 to limit the vertical travel of central block 21. The illustrated prior art stock lifter 20 also includes a pair of side blocks 24 and 25, which are also individually designed and formed from a block of steel, and include vertical mounting apertures 33 through which fasteners 34 are inserted and engaged into mating threaded holes 34*a* to attach the same to the upper surface of die block 29. Two spring units 26 and 27 have their upper ends mounted within the interior of central block 21, and their lower ends received in specially formed, blind or flat bottom holes 35 in die set 28. The diameter and depth of blind holes 35 must be very accurately machined and ground, so as to ensure proper operation of stock lifter 20. Each of the threaded mounting holes 32*a* and 34*a* in the upper surface of die block 29 must be precisely located and formed to receive one of the fine threaded fasteners 32 and 34, since the fasteners 32 and 34 not only securely attach the various components 21–27 to die block 29, but must also accurately locate the components 21–27 relative to each other, as well as the other components of the progressive die 2. In general, this type of precision mounting of multiple stock lifter components 21–27 is very difficult and time consuming, since the die block 28 is so large and heavy that it cannot be transported for precision machining on the bed of a machining tool. Rather, portable machining tools must be brought to the die plate, and carefully set up to perform the required machining operations, such as milling blind holes, grinding precision surfaces, etc. Furthermore, the various stock lifter components 21–27 themselves must be carefully crafted to exact dimensions and tolerances, so as to achieve proper reciprocation of central block 21, and cooperate with the other die components. The large number of individual parts in prior art stock lifter 20 makes this difficult and expensive.

In contrast to the prior art stock lifter 20 shown in FIG. 1, and with reference to FIGS. 2–4 and 7–8, the present invention includes a separate base plate 3, which in the illustrated example, has a generally rectangular shape, comprising flat and mutually parallel upper and lower surfaces 40 and 41, side surfaces 42 and 43, and end surfaces 44 and 45. Guide shaft apertures 4 and 5 are cylindrical in shape, vertically oriented and mutually parallel, and extend completely through base plate 3 adjacent opposite sides of the same. In the illustrated example, cylindrical bushings 46 and 47 are closely received and retained in guide shaft apertures 4 and 5, and have an inside diameter dimensioned to closely receive therein guide shafts 10 and 11, so as to provide removable, load bearing sleeves which can be replaced when worn. The illustrated base plate 3 includes a pair of grease fittings 55 mounted in side face 42 to provide lubricant to the interior of bushings 46 and 47. In the illustrated example, spring unit aperture 6 is also vertically oriented and mutually parallel with guide shaft apertures 4 and 5, and includes a threaded interior surface designed to mate with a threaded exterior surface on the base 13 of spring unit 12, as described in greater detail hereinafter. Spring unit aperture 6 is located centrally in base plate 3, equidistant from the opposite guide shaft apertures 4 and 5. A set screw 56 is preferably mounted in the side face 42 of base plate 3 to detachably retain spring unit 12 in its selected position, as described below in greater detail. The illustrated base plate 3 also includes seven additional mounting apertures 48–54, which extend completely through base plate 3, and are configured to mount stock lifter 1 to die set 2 in the manner described below. More specifically, apertures 48 and 49 are configured to closely receive locating dowels 37 therein, apertures 50 and 51 are configured to receive hex head screws therein, and apertures 52–54 are configured to receive jack screws therein.

The illustrated lifter bar 7 (FIGS. 2–6) also has a generally rectangular shape defined by flat, generally parallel upper and lower surfaces 57 and 58, side surfaces 59 and 60, and end surfaces 61 and 62. Mounting apertures 8 and 9 are also vertically oriented and mutually parallel, and are positioned in vertical registry with the guide shaft apertures 4 and 5 in base plate 3. Guide shaft apertures 8 and 9 are cylindrical in shape, and have a diameter dimensioned less than the diameter of guide shafts 10 and 11, for reasons to be described below.

Guide shafts 10 and 11 (FIGS. 2–4 and 9) have a cylindrical construction, and are preferably constructed from hardened steel. Each of the guide shafts 10 and 11 includes an upper surface 66 and a vertically oriented flat 67 on the cylindrical face of the associated guide shaft to facilitate attachment of a tool, such as a wrench or the like, to the guide shaft to prevent rotation during assembly and/or repair. Each of the illustrated guide shafts 10 and 11 also includes a stop 68 formed integrally on the lower end thereof in the shape of a radially extending collar, which is adapted to abut the lower surface 41 of base plate 3 during operation to limit reciprocation of lifter bar 7. In the illustrated example, annularly-shaped bumpers 69 are positioned about guide shafts 10 and 11 adjacent stop 68 to cushion impact between stop 68 and the lower surface 41 of base plate 3 during operation. The upper ends 66 of both of the illustrated guide shafts 10 and 11 include vertically oriented threaded fastener apertures 70. When assembled, the upper ends 66 of guide shafts 10 and 11 abut the lower surface 58 of lifter bar 7, and threaded fasteners 71 extend through guide shaft apertures 8 and 9 and into the threaded fastener apertures 70 to removably interconnect base plate 3, lifter bar 7 and guide shafts 10 and 11.

The illustrated spring unit 12 (FIGS. 2–4) has base portion 13 with a threaded exterior surface that is adapted to mate with the threaded interior surface of the spring unit aperture 6 in base plate 3. Axial rotation of the base portion 13 of spring unit 12 varies the axial position of rod portion 14 relative to lifter bar 7 to permit making stock lifters 1 having different vertical lifts from the same base plate 3, lifter bar 7 and spring unit 12. The illustrated spring unit 12 is gas pressure operated, and otherwise has a substantially conventional construction, such that the same can be readily removed and replaced if necessary. However, it is to be understood that the present invention contemplates use of other types of spring units.

The illustrated stock lifter 1 also includes a stock guide 75 (FIGS. 2–4 and 10), which is mounted to the upper surface 57 of lifter bar 7, and serves to longitudinally position the stock as it traverses through progressive die 2, as explained in greater detail thereinafter. The illustrated stock guide 75 has a generally inverted L-shaped end elevational configuration, comprising a rectangular base 76 having an inwardly protruding flange 77 extending from the upper surface thereof. Stock guide 75 includes generally flat, mutually parallel upper and lower surfaces 78 and 79, side surfaces 80 and 81, and end surfaces 82 and 83. Flange 77 projects inwardly from side surface 80, so as to form a channel 90 with the upper surface 57 of lifter bar 7 in which the side edge of an associated piece of metal stock is captured, and thereby guided through progressive die 2. Two counterbored mounting apertures 84 and 85 extend vertically through stock guide 75 adjacent opposite ends thereof. Mounting apertures 84 and 85 are located in vertical registry with apertures 8 and 9 in lifter bar 7, and are configured to receive fasteners 71 therein, as discussed below. The illustrated stock guide 75 also includes three vertically oriented, mutually parallel attachment apertures 86–88, which may be used to attach additional accessories (not shown) to stock lifter 1.

The illustrated stock lifter 1 is assembled in the following fashion. Bushings 46 and 47 are press fit into the apertures 4 and 5 of base plate 3. Guide shafts 10 and 11, with bumpers 69 mounted adjacent stop 68, are then inserted through the lower ends of the bushings 46 and 47 in guide shaft apertures 4 and 5, such that the upper ends 66 of guide shafts 10 and 11 project upwardly. The outer surfaces of guide shafts 10 and 11 are smooth and hardened, so as to be closely, yet slidably, received within the interiors of mating bushings 46 and 47. The base 13 of spring unit 12 is then threadedly engaged in the threaded spring unit aperture 6 in base plate 3 and adjusted vertically by rotating the same axially. Preferably, spring unit 12 is initially adjusted so that the free end 15 is located slightly below the lower surface 58 of lifter bar 7, so as to facilitate assembly. Lifter bar 7 is then positioned on top of the top surfaces 66 of guide shafts 10 and 11, with fastener apertures 70 vertically aligned and centered with the mounting apertures 8 and 9 in lifter bar 7. Stock guide 75 is then positioned on top of lifter bar 7, with apertures 84 and 85 vertically aligned and centered with apertures 8 and 9 in lifter bar 7. Fasteners 71 are then inserted through apertures 84 and 85 in stock guide 75, mounting apertures 8 and 9 in lifter bar 7, and threadedly engaged in the fastener apertures 70 in the top ends 66 of guide shafts 10 and 11. As a result of this construction, lifter bar 7 reciprocates relative to base plate 3 on guide shafts 10 and 11 in a vertical direction, and requires only a single spring unit 14, unlike the prior art spring lifter 20, which requires two spring units 26 and 27. Spring unit 12 is then vertically adjusted by axially rotating base 13, thereby causing rod 14 to retract and apply a preselected biasing force to lifter bar 7. Once stock lifter 20 has been properly adjusted, set screw 56 is tightened to retain the base 13 of stock lifter 20 in its adjusted position in base plate 3.

As best illustrated in FIGS. 11–15, the assembled stock lifter 1 is mounted in an associated die set 28, which includes a lower die block 29. Three apertures 95, 96 and 97 are drilled completely through lower die block 29 at locations vertically aligned with guide shafts 10 and 11 and spring unit 12. Apertures 95–97 are sized so as to permit the lower ends of guide shafts 10 and 11 and spring unit base 13 to shift freely therein in a vertical direction. Since apertures 95–97 are through apertures, they need not be precisely formed, nor are their dimensioning or tolerances particularly critical to installation of stock lifter 1 in die set 28. Threaded apertures 98 and locating pin apertures 99 are also formed in the upper surface of lower die block 29 to mount stock lifter 1 onto the upper surface of lower die block 29. In contrast to prior art stock lifter 20, the only precision holes necessary to mount stock lifter 1 are locator holes 99 for associated locator pins 37. Since locator holes 99 are elatively small in diameter, and extend all of the way through base plate 3, they can be formed relatively easily and quickly. Because the locator pins 37 locate base plate 3 on lower die block 29, threaded holes 98 need not be as precise as those required for prior art stock lifter 20, since they serve only to hold base plate 3 down on lower die block 29. Base plate 3 serves to accurately locate the remaining components of stock lifter 1. Since base plate 3 is small enough to be formed in a conventional machining tool, such as the CNC machine noted above, all dimensions, holes and tolerances are precise, and the part can be quickly made in a very economical manner.

Figure 13:
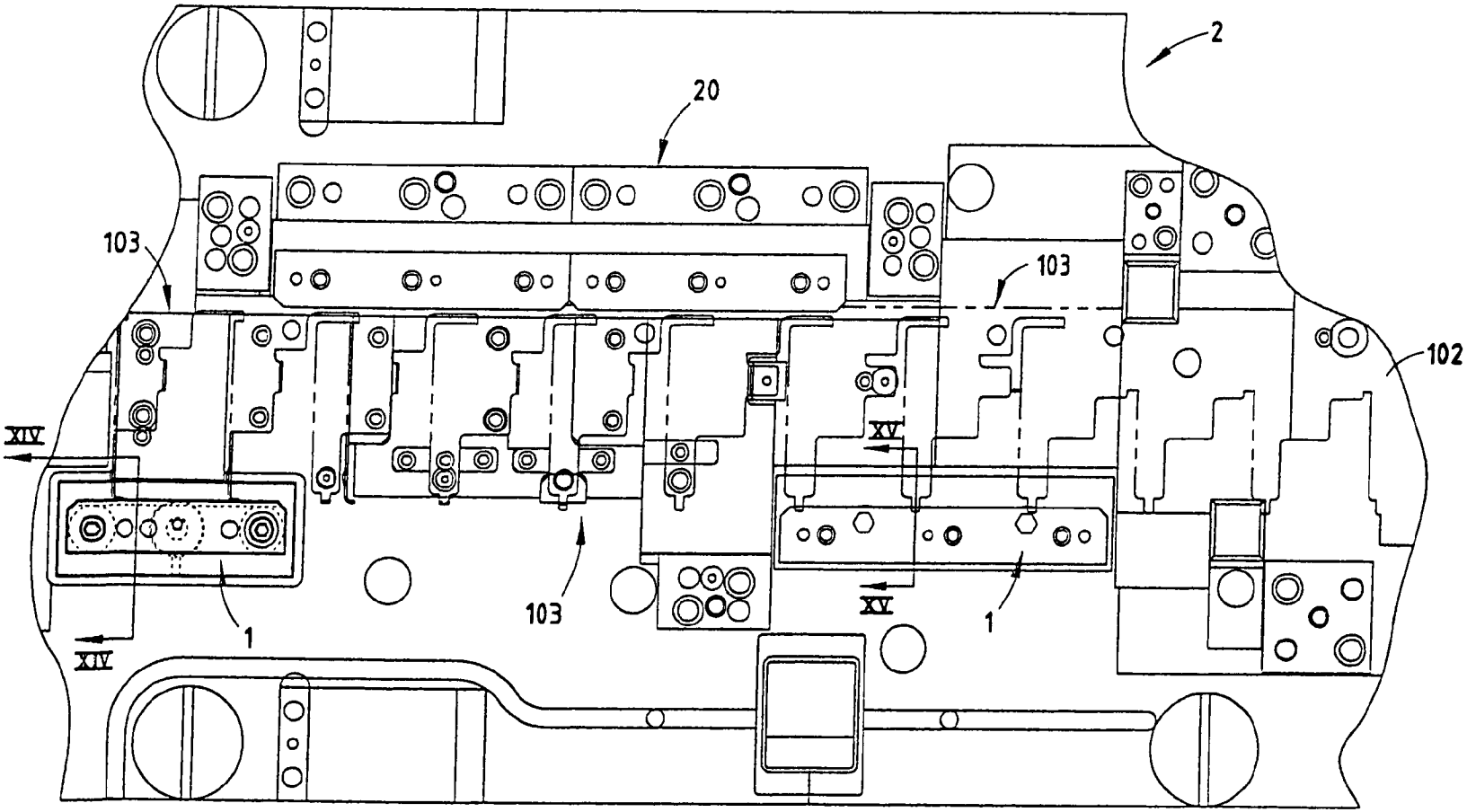
FIG. 13 is a partially schematic, fragmentary top plan view of a lower die block with the stock lifter installed therein.
Figure 15:
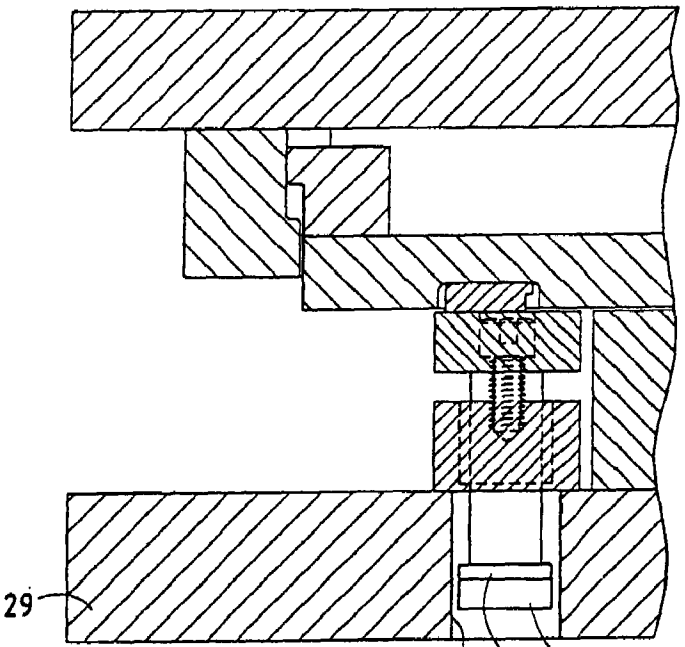
FIG. 15 is a vertical cross-sectional view of the lower die block, taken along the line XV—XV, FIG. 13.
Figure 14:
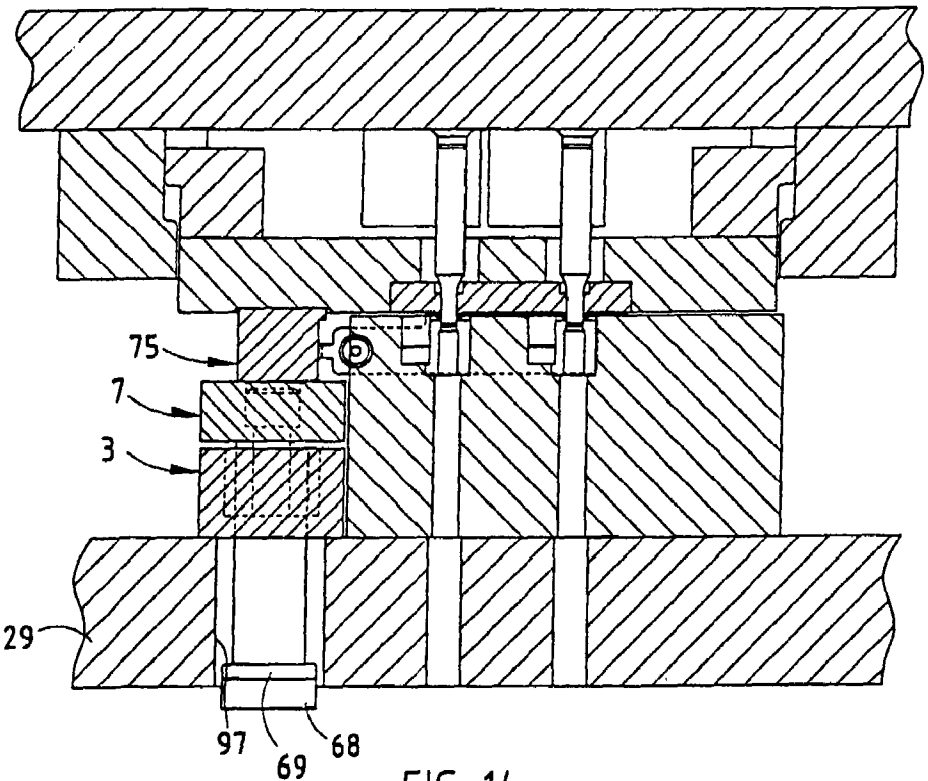
FIG. 14 is a vertical cross-sectional view of the lower die block, taken along the line XIV—XIV, FIG. 13.

As best illustrated in FIGS. 13–15, a plurality of stock lifters 1 are typically used in any given die set 28, and are normally positioned on opposite sides of a strip of stock material, such as steel or the like. In the illustrated example, a strip of sheet metal stock 102 is fed longitudinally through progressive die 2, and has various operations performed at each of the progressions or stations 103. Stock lifters 1 are positioned on opposite sides of the workstations, and serve to shift the stock 102 upwardly, when the upper die block (not shown) is shifted to its raised position, thereby permitting stock 102 to shifted longitudinally through progressive die 2. For illustrative purposes, the progressive die 2 shown in FIG. 13 has prior art stock lifters 20 on one side of the stock 102, and two stock lifters 1 on the opposite side of stock 102.

Preferably, the various parts of stock lifter 1, including base plate 3 and lifter bar 7, are designed and manufactured in a modular fashion to reduce manufacturing costs. For example, the two stock lifters 1 shown in FIG. 13 are somewhat different in size, but contain the same basic components, comprising a base plate 3, a lifter bar 7, two guide shafts 10 and 11 and a spring unit 12. Preferably, this modular construction is incorporated into computer software, so as to be able to simply input the specific size stock lifter desired, and then compute through the software the specific shape, size, hole locations, etc. of each of the basic lifter components. In one working example of the present invention, signals and/or instructions generated by such computer software and hardware are fed directly into a CNC machine to automatically form the stock lifter components without the need for layout drawings. The computer software may also designate the precise size and shape of the stock block from which any given lifter component is to be made, so that the same can be quickly cut from a bar of preselected stock and fixtured in the CNC machine. Consequently, stock lifters 1 of various shapes and sizes can be made quickly in a very cost effective manner, as compared to those prior art techniques discussed above.

In one example of the present invention, base plate 3 is preferably cut to length from a bar steel having a width and thickness substantially commensurate with the predetermined width and thickness of base plate 3. In this manner, minimum machining is required to make base plate 3. Guide shafts 10 and 11 may be made from hardened steel, such that base plate 3 need not be hardened after assembly of stock lifter 1. In one working example of the present invention, base plate 3 is preferably cut from a bar of 4140 cold drawn steel, which is precisely dimensioned in width and thickness, such that the only dimension requiring finishing is the cut end.

Stock lifter 1 has a self-contained design which greatly reduces the time, difficulty and expense associated with installing the same in a die set. Also, the modular construction of stock lifter 1, particularly as incorporated into base plate 3, lifter bar 7 and stock guide 75, combined with the use of standard components, such as guide shafts 10 and 11, bushings 46 and 47 and spring unit 12, substantially reduces the amount of time and effort necessary to design and make stock lifter 1, thereby resulting in significant cost savings. The combined effect of the self-contained design and modular construction of stock lifter 1 represents a significant advancement in the art of metal forming dies.

It is to be understood that the self-contained design and/or modular construction of stock lifter 1, as disclosed herein, may be applied to other die components, such as stock guides, end caps and keepers, cam returns, and the like, so as to reduce the time, cost and effort associated with designing and manufacturing metal forming dies.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a progressive metal forming die of the type having multiple stations, the improvement of a self-contained stock lifter, comprising:

a base plate having first and second vertically oriented, mutually parallel mounting apertures extending completely through said base plate adjacent opposite sides thereof, at least one fastener mechanism for connecting said stock lifter to said metal forming die, and at least one vertically oriented spring unit aperture extending completely through said base plate at a location generally intermediate said first and second mounting apertures;

a lifter bar having third and fourth vertically oriented, mutually parallel mounting apertures extending completely through said lifter bar adjacent opposite sides thereof in vertical registry with said first and second mounting apertures, and including a central portion disposed generally intermediate of said third and fourth mounting apertures;

at least two rigid guide shafts extending between said base plate and said lifter bar, and having first ends thereof received in said first and second mounting apertures to permit said lifter bar to reciprocate between extended and retracted positions in a manner which selectively lifts stock in said metal forming die to permit shifting the stock longitudinally along said multiple stations of said metal forming die;

a spring unit having a base portion thereof received in said spring unit aperture in said base plate, and a reciprocating rod portion extending outwardly from said base portion and being biased outwardly to an extended position; said rod portion having a free end thereof which abuts said central portion of said lifter bar to shift said lifter bar to the extended position, whereby said stock lifter defines a fully self-contained unit that can be readily mounted in and removed from said metal forming die to reduce the cost of manufacturing and repairing said metal forming die; and means for adjustably mounting said base portion of said spring unit on said base plate to permit selected vertical shifting of said base portion of said spring unit relative to said base plate to vary the axial position of said rod portion relative to said lifter bar to permit making stock lifters having different vertical lifts.

2. A progressive die as set forth in claim 1, wherein:

said mounting means includes a lock fastener mounted in said base plate, and engaging said base portion of said spring unit to retain said base portion in a selected position in said base plate.

3. A progressive die as set forth in claim 2, including:

fasteners extending through said third and fourth mounting apertures in said lifter bar, and connecting second ends of said guide shafts with said lifter bar; and stops positioned on the first ends of said guide shafts and having radially extending collars which selectively abut said base plate to limit reciprocation of said lifter bar.

4. A progressive die as set forth in claim 3, wherein:

said fastener mechanism comprises an aperture extending completely through said base plate.

5. A progressive die as set forth in claim 4, including:

at least two bushings, each having an outside surface and an inside surface shaped to closely receive one of said guide shafts therein; and wherein said first and second guide shaft apertures are shaped to closely receive the outside surface of an associated one of said bushings therein.

6. A progressive die as set forth in claim 5, wherein:

said base plate has a predetermined length, width and thickness; and said base plate is cut to length from a bar of steel having a width and thickness substantially commensurate with the predetermined width and thickness of said base plate to minimize machining said base plate.

7. A progressive die as set forth in claim 6, wherein:

said guide shafts are constructed from a hardened steel, such that said base plate need not be hardened after assembly of said stock lifter.

8. A progressive die as set forth in claim 7, wherein:

said bar from which said base plate is cut is constructed from 4140 cold drawn steel.

9. A progressive die as set forth in claim 8, wherein:

said die includes a lower die block with through apertures disposed directly below said first and second shaft mounting apertures to avoid machining said lower die block.

10. A progressive die as set forth in claim 9, wherein:

said stock lifter includes a stock guide connected with said lifter bar, and configured to guide the stock along said multiple stations of said metal forming die.

11. A progressive die as set forth in claim 10, wherein:

said mounting means includes an internal thread in said spring unit aperture in said base plate; and said base portion of said spring unit includes an external thread which mates with said internal thread of said spring unit aperture, such that rotation of said base portion of said spring unit relative to said base plate varies the axial position of said rod portion relative to said lifter bar to permit making stock lifters having different vertical lifts.

12. A progressive die as set forth in claim 1, including:

fasteners extending through said third and fourth mounting apertures in said lifter bar, and connecting second ends of said guide shafts with said lifter bar; and stops positioned on the first ends of said guide shafts and having radially extending collars which selectively abut said base plate to limit reciprocation of said lifter bar.

13. A progressive die as set forth in claim 1, wherein:

said fastener mechanism comprises an aperture extending completely through said base plate.

14. A progressive die as set forth in claim 1, including:

at least two bushings, each having an outside surface and an inside surface shaped to closely receive one of said guide shafts therein; and wherein said first and second guide shaft apertures are shaped to closely receive the outside surface of an associated one of said bushings therein.

15. A progressive die as set forth in claim 1, wherein:

said base plate has a predetermined length, width and thickness; and said base plate is cut to length from a bar of steel having a width and thickness substantially commensurate with the predetermined width and thickness of said base plate to minimize machining said base plate.

16. A progressive die as set forth in claim 1, wherein:

said guide shafts are constructed from a hardened steel, such that said base plate need not be hardened after assembly of said stock lifter.

17. A progressive die as set forth in claim 1, wherein:

said die includes a lower die block with through apertures disposed directly below said first and second shaft mounting apertures to avoid machining said lower die block.

18. A progressive die as set forth in claim 1, wherein:

said stock lifter includes a stock guide connected with said lifter bar, and configured to guide the stock along said multiple stations of said metal forming die.

19. A progressive die as set forth in claim 1, wherein:

said mounting means includes an internal thread in said spring unit aperture in said base plate; and said base portion of said spring unit includes an external thread which mates with said internal thread of said spring unit aperture, such that rotation of said base portion of said spring unit relative to said base plate varies the axial position of said rod portion relative to said lifter bar to permit making stock lifters having different vertical lifts.

20. A self-contained, modular stock lifter assembly for progressive metal forming dies of the type having multiple stations, comprising:

a modular base plate having first and second vertically oriented, mutually parallel mounting apertures extending completely through said modular base plate adjacent opposite sides thereof, at least one fastener mechanism for connecting said stock lifter assembly to an associated metal forming die, and at least one vertically oriented spring unit aperture extending completely through said base plate at a location generally intermediate said first and second mounting apertures;

a modular lifter bar having third and fourth vertically oriented, mutually parallel mounting apertures extending completely through said modular lifter bar adjacent opposite sides thereof in vertical registry with said first and second mounting apertures, and including a central portion disposed generally intermediate of said third and fourth mounting apertures;

at least two rigid guide shafts extending between said modular base plate and said modular lifter bar, and having first ends thereof received in said first and second mounting apertures to permit said modular lifter bar to reciprocate between extended and retracted positions in a manner which selectively lifts stock in the metal forming die to permit shifting the stock along the multiple stations of the metal forming die;

a spring unit having a base portion thereof received in said spring unit aperture in said modular base plate, and a reciprocating rod portion extending outwardly from said base portion and being biased outwardly to an extended position; said rod portion having a free end thereof which abuts said central portion of said modular lifter bar to shift said modular lifter bar to the extended position, whereby said stock lifter assembly defines a fully self-contained unit that can be readily mounted in and removed from the metal forming die to reduce the cost of manufacturing and repairing the metal forming die; and means for adjustably mounting said spring unit base portion on said base plate to permit selected vertical shifting of said spring unit base relative to said modular base plate to vary the axial position of said rod portion relative to said modular lifter bar to permit making modular stock lifter assemblies having different vertical lifts.

21. A stock lifter assembly as set forth in claim 20, wherein:

said mounting means includes a lock fastener mounted in said base plate, and engaging said base portion of said spring unit to retain said base portion in a selected position in said base plate.

22. A stock lifter assembly as set forth in claim 20, including:

fasteners extending through said third and fourth mounting apertures in said lifter bar, and connecting second ends of said guide shafts with said lifter bar; and stops positioned on the first ends of said guide shafts and having radially extending collars which selectively abut said base plate to limit reciprocation of said lifter bar.

23. A stock lifter assembly as set forth in claim 20, wherein:

said fastener mechanism comprises an aperture extending completely through said base plate.

24. A stock lifter assembly as set forth in claim 20, including:

at least two bushings, each having an outside surface and an inside surface shaped to closely receive one of said guide shafts therein; and wherein said first and second guide shaft apertures are shaped to closely receive the outside surface of an associated one of said bushings therein.

25. A stock lifter assembly as set forth in claim 20, wherein:

said base plate has a predetermined length, width and thickness; and said base plate is cut to length from a bar of steel having a width and thickness substantially commensurate with the predetermined width and thickness of said base plate to minimize machining said base plate.

26. A stock lifter assembly as set forth in claim 20, wherein:

said guide shafts are constructed from a hardened steel, such that said base plate need not be hardened after assembly of said stock lifter.

27. A stock lifter assembly as set forth in claim 20, including:

a stock guide connected with said lifter bar, and configured to guide the stock along said multiple stations of the metal forming die.

28. A stock lifter assembly as set forth in claim 20, wherein:

said mounting means includes an internal thread in said spring unit aperture in said base plate; and said base portion of said spring unit includes an external thread which mates with said internal thread of said spring unit aperture, such that rotation of said base portion of said spring unit relative to said base plate varies the axial position of said rod portion relative to said lifter bar to permit making stock lifters having different vertical lifts.

29. A stock lifter for metal forming dies, comprising:

a base plate having first and second vertically oriented, mutually parallel mounting apertures extending completely through said base plate adjacent opposite sides thereof, at least one fastener mechanism for connecting said stock lifter to an associated metal forming die, and at least one vertically oriented spring unit aperture extending completely through said base plate at a location generally intermediate said first and second mounting apertures;

a lifter bar having third and fourth vertically oriented, mutually parallel mounting apertures extending completely through said lifter bar adjacent opposite sides thereof in vertical registry with said first and second mounting apertures, and including a central portion disposed generally intermediate of said third and fourth mounting apertures;

at least two rigid guide shafts extending between said base plate and said lifter bar, and having first ends thereof received and retained in said first and second mounting apertures to permit said lifter bar to reciprocate between extended and retracted positions in a manner which selectively lifts stock in the metal forming die;

a self-contained spring unit having a base portion thereof received in said spring unit aperture in said base plate, and a reciprocating rod portion extending outwardly from said base portion and being biased outwardly to an extended position; said rod portion having a free end thereof which abuts said central portion of said lifter bar to shift said lifter bar to the extended position; and wherein means for adjustably mounting said spring unit base portion on said base plate to permit selected vertical shifting of said spring unit base relative to said base plate to vary the axial position of said rod portion relative to said lifter bar to permit making stock lifters having different vertical lifts.

30. A method for making a stock lifter for progressive metal forming dies of the type having multiple stations, comprising:

cutting lengths of bar stock to define a plurality of base plates, each having a different, predetermined length;

forming in each of the base plates first and second vertically oriented, mutually parallel guide shaft mounting apertures completely through the associated base plate adjacent opposite sides thereof;

providing each of the base plates with at least one fastener mechanism for connecting the associated stock lifter to a metal forming die;

forming in each of the base plates at least one vertically oriented spring unit aperture extending completely through the associated base plate at a location generally intermediate the first and second guide shaft mounting apertures in the associated base plate;

forming internal threads in the spring unit aperture of each of the base plates;

cutting lengths of bar stock to define a plurality of lifter bars, each having a different, predetermined length which corresponds with an associated one of the base plates;

forming third and fourth vertically oriented, mutually parallel mounting apertures completely through each of the lifter bars adjacent opposite sides thereof for vertical registry with the first and second mounting apertures in the associated one of the base plates;

providing a plurality of rigid guide shafts, each having first and second ends;

selecting one of the base plates and the associated one of the lifter bars in accordance with the stock lifting requirements of a selected one of the stations of the associated progressive metal forming die;

selecting two of the guide shafts;

positioning the guide shafts between the one base plate and the one lifter bar, so that the first ends of the guide shafts are received in the first and second mounting apertures of the one base plate to permit the one lifter bar to reciprocate between extended and retracted positions in a manner which selectively lifts stock in the selected station of the metal forming die to permit shifting the stock along the multiple stations of the metal forming die;

providing a self-contained spring unit having a base portion, and a reciprocating rod portion extending outwardly from the base portion and being biased outwardly to an extended position;

forming external threads in the base portion of the spring unit which mate with the internal threads of the associated spring unit aperture; and positioning the self-contained spring unit between the one base plate and the one lifter bar, such that the free end of the rod portion abuts the central portion of the one lifter bar to shift the one lifter bar to the extended position; and the base portion of the spring unit is received and retained threadedly in the spring unit aperture in the one base plate, such that rotation of the associated spring unit base relative to the associated base plate varies the axial position of the rod portion relative to the one lifter bar to permit making stock lifters having different vertical lifts.

31. A method as set forth in claim 30, wherein:

said base plate cutting step includes:

selecting a bar of steel having a width and thickness substantially commensurate with the width and thickness of the associated base plate; and cutting the bar to a length substantially commensurate with the length of the associated base plate to minimize machining.

32. A method as set forth in claim 30, wherein:

said lifter bar cutting step includes:

selecting a bar of steel having a width and thickness substantially commensurate with the width and thickness of the associated lifter bar; and cutting the bar to a length substantially commensurate with the length of the associated lifter bar to minimize machining.

33. A method as set forth in claim 30, wherein:

said bar selecting step includes selecting the bar from 4140 cold drawn steel, so as to reduce machining operations.

34. A method as set forth in claim 30, wherein:

said first and second mounting aperture forming step comprises drilling the first and second mounting apertures completely through the associated base plate to avoid grinding.

35. A method as set forth in claim 30, including:

mounting a lock fastener in the one base plate to engage the base portion of the one spring unit to retain the base portion in the selected rotational position in the one base plate.

36. A method as set forth in claim 30, including:

inserting fasteners through the third and fourth mounting apertures in the one lifter bar, and connecting second ends of the guide shafts with the one lifter bar; and connecting stops to the first ends of the guide shafts, which have radially extending collars that selectively abut the one base plate to limit reciprocation of the lifter bar.

37. A method for making a stock lifter for progressive metal forming dies of the type having multiple stations, comprising:

cutting lengths of bar stock to define a plurality of base plates, each having a different, predetermined length;

forming in each of the base plates first and second vertically oriented, mutually parallel guide shaft mounting apertures completely through the associated base plate adjacent opposite sides thereof;

providing each of the base plates with at least one fastener mechanism for connecting the associated stock lifter to a metal forming die;

forming in each of the base plates at least one vertically oriented spring unit aperture extending completely through the associated base plate at a location generally intermediate the first and second guide shaft mounting apertures in the associated base plate;

inventorying a supply of the finished base plates in a variety of the different predetermined lengths;

cutting lengths of bar stock to define a plurality of lifter bars, each having a different, predetermined length which corresponds with an associated one of the base plates;

forming third and fourth vertically oriented, mutually parallel mounting apertures completely through each of the lifter bars adjacent opposite sides thereof for vertical registry with the first and second mounting apertures in the associated one of the base plates;

inventorying a supply of the finished lifter bars in a variety of the different predetermined lengths;

providing a plurality of rigid guide shafts, each having first and second ends;

selecting one of the inventoried base plates and the associated one of the inventoried lifter bars in accordance with the stock lifting requirements of a selected one of the stations of the associated progressive metal forming die;

selecting two of the guide shafts;

positioning the guide shafts between the one base plate and the one lifter bar, so that the first ends of the guide shafts are received in the first and second mounting apertures of the one base plate to permit the one lifter bar to reciprocate between extended and retracted positions in a manner which selectively lifts stock in the selected station of the metal forming die to permit shifting the stock along the multiple stations of the metal forming die;

providing a self-contained gas spring unit having a base portion, and a reciprocating rod portion extending outwardly from the base portion and being biased outwardly to an extended position; and positioning the self-contained gas spring unit between the one base plate and the one lifter bar, such that the base portion of the gas spring unit is received and retained in the spring unit aperture in the one base plate, and the free end of the rod portion abuts the central portion of the one lifter bar to shift the one lifter bar to the extended position.

38. A method as set forth in claim 37, wherein:

said base plate cutting step includes:

selecting a bar of steel having a width and thickness substantially commensurate with the width and thickness of the associated base plate; and cutting the bar to a length substantially commensurate with the length of the associated base plate to minimize machining.

39. A method as set forth in claim 38, wherein:

said lifter bar cutting step includes:

selecting a bar of steel having a width and thickness substantially commensurate with the width and thickness of the associated lifter bar; and cutting the bar to a length substantially commensurate with the length of the associated lifter bar to minimize machining.

40. A method as set forth in claim 39, wherein:

each of said bar selecting steps includes selecting the bar from 4140 cold drawn steel, so as to reduce machining operations.

41. A method as set forth in claim 40, wherein:

said first and second mounting aperture forming step comprises drilling the first and second mounting apertures completely through the associated base plate to avoid grinding.

* * * * *